US008715567B2

(12) United States Patent
Gillespie et al.

(10) Patent No.: US 8,715,567 B2
(45) Date of Patent: May 6, 2014

(54) FURNACE TAP HOLE FLOW CONTROL AND TAPPER SYSTEM AND METHOD OF USING THE SAME

(75) Inventors: Jon Richard Gillespie, Catawissa, MO (US); Robert Alan Nash, II, Festus, MO (US); Gregory Kurt Schroeder, St. Louis, MO (US)

(73) Assignee: Gillespie + Powers, Inc., St. Louis, MO (US)

( * ) Notice: Subject to any disclaimer, the term of this patent is extended or adjusted under 35 U.S.C. 154(b) by 342 days.

(21) Appl. No.: 13/241,697

(22) Filed: Sep. 23, 2011

(65) Prior Publication Data

US 2012/0074620 A1 Mar. 29, 2012

Related U.S. Application Data

(60) Provisional application No. 61/385,731, filed on Sep. 23, 2010.

(51) Int. Cl.
*F27D 3/15* (2006.01)

(52) U.S. Cl.
USPC ..... 266/272; 222/590; 222/601

(58) Field of Classification Search
USPC ..... 266/45, 236, 271, 272; 222/590, 594, 222/601
See application file for complete search history.

(56) References Cited

U.S. PATENT DOCUMENTS

| | | | | |
|---|---|---|---|---|
| 2,821,378 | A * | 1/1958 | Tama | 266/236 |
| 3,549,141 | A | 12/1970 | Zimmermann et al. | |
| 4,232,855 | A * | 11/1980 | Hartl | 266/272 |
| 4,607,681 | A * | 8/1986 | Tinnes et al. | 164/453 |
| 4,865,234 | A * | 9/1989 | Folgero | 222/597 |
| 5,229,063 | A * | 7/1993 | Stomp et al. | 266/45 |
| 6,110,415 | A | 8/2000 | Hickman et al. | |
| 6,471,911 | B1 | 10/2002 | Pleschiutschnigg et al. | |
| 7,767,137 | B2 | 8/2010 | Wunsche | |
| 2012/0074620 | A1 * | 3/2012 | Gillespie et al. | 266/45 |

FOREIGN PATENT DOCUMENTS

| | | | |
|---|---|---|---|
| JP | 56096006 | A | 8/1981 |
| JP | 61088960 | A | 5/1986 |
| JP | 61257408 | A | 11/1986 |
| JP | 2007197738 | | 8/2007 |
| KR | 1020090113691 | | 11/2009 |

OTHER PUBLICATIONS

PCT International Search Report dated Apr. 13, 2012, for the International Application No. PCT/US2011/052924, International Filing Date Sep. 23, 2011.

PCT Written Opinion of the International Searching Authority dated Apr. 13, 2012, for the International Application No. PCT/US2011/052924, International Filing Date Sep. 23, 2011.

* cited by examiner

*Primary Examiner* — Scott Kastler
(74) *Attorney, Agent, or Firm* — Polster, Lieder, Woodruff & Lucchesi, L.C.

(57) ABSTRACT

A molten metal flow controller (10) for a metal melt furnace having a tap hole (T) to release the molten metal from the furnace, where the controller (10) is configured to controllably release the flow of molten metal through the tap hole (T) using an actuator (14) that controllably moves a plunger (110) into and out of the tap hole (T) in response the increase or decrease in the molten metal flow rate through the tap hole (t) as measured by a sensor (130).

25 Claims, 5 Drawing Sheets

FURNACE TAP HOLE FLOW CONTROL AND TAPPER SYSTEM AND METHOD OF USING THE SAME

CROSS REFERENCE TO RELATED APPLICATIONS

This application derives and claims priority from U.S. provisional application 61/385,731 filed 23 Sep. 2010, which application is incorporated herein by reference.

STATEMENT REGARDING FEDERALLY SPONSORED RESEARCH OR DEVELOPMENT

Not applicable.

BACKGROUND OF THE INVENTION

This invention relates principally to a metal melt oven or furnace, and more particularly to a unique automatic metal flow tapper and flow control system for a metal melt oven or furnace.

When a metal melt oven or furnace (collectively "Melt Furnace") is constructed, the Melt Furnace typically incorporates one or more plugged "tap" holes formed and positioned near the base of the melt zone to remove the melt from the furnace. When the molten metal is ready to be removed from the Melt Furnace, the plug or plugs are removed and the molten metal is allowed to flow freely out of the tap hole. It is also traditional that a trough or other similar conduit will be positioned below the level of the tap hole to gather and direct the molten metal away from the Melt Furnace. Alternately, a collection vessel may be positioned directly below the tap hole(s) to collect the molten metal as it exits the Melt Furnace.

Prior to the availability of automated tapping devices, the plugging and unplugging, i.e. "tapping", of the tap holes in a Melt Furnace was conducted by an individual utilizing a manual tapper. Such manual tappers were constructed in a wide variety of configurations, but essentially consisted of a long pole with a pointed end used to tap and plug the tap hole. Despite the inherent dangers to the individual performing the tapping, this technique is still used in many operations yet today. Fortunately, automated tappers have been developed that remove the human element from too close contact with the furnace. One such automatic tapper is the Gillespie & Powers, Inc. Model 995. Automatic tappers are mechanisms that remotely force a tap hole plug in the tap hole to shut off metal flow from the furnace, and alternately remove the plug to allow the metal to flow out of the tap hole. Thus, automatic tappers provide binary control of the metal flow in an ON-OFF fashion. This is a relatively crude and inaccurate approach.

However, for many metal furnace operations, the rate molten metal flow out of the furnace through the tap hole or tap holes can be a critical process parameter, which may require constant monitoring and adjustment. In a simple example, for a continuous flow Aluminum Melt Furnace, the volume of the melt is essentially constant and the Aluminum melt flowing out of the Aluminum Melt Furnace therefore limits the throughput of the operation. Significantly, neither a traditional automatic tapper nor a manual tap rod is capable of easily or accurately controlling the metal flow out of a tap hole in a repeatable fashion. Hence, there is a need in the industry for a mechanism to provide more accurate and repeatable control of molten metal flow from a Melt Furnace tap hole while also having the capability to plug or entirely shut off the metal flow from the tap hole.

As will become evident in this disclosure, the present invention provides benefits over the existing art.

BRIEF DESCRIPTION OF THE DRAWINGS

The illustrative embodiments of the present invention are shown in the following drawings which form a part of the specification.

Corresponding reference characters indicate corresponding parts throughout the several views of the drawings.

DETAILED DESCRIPTION

Figure 2:
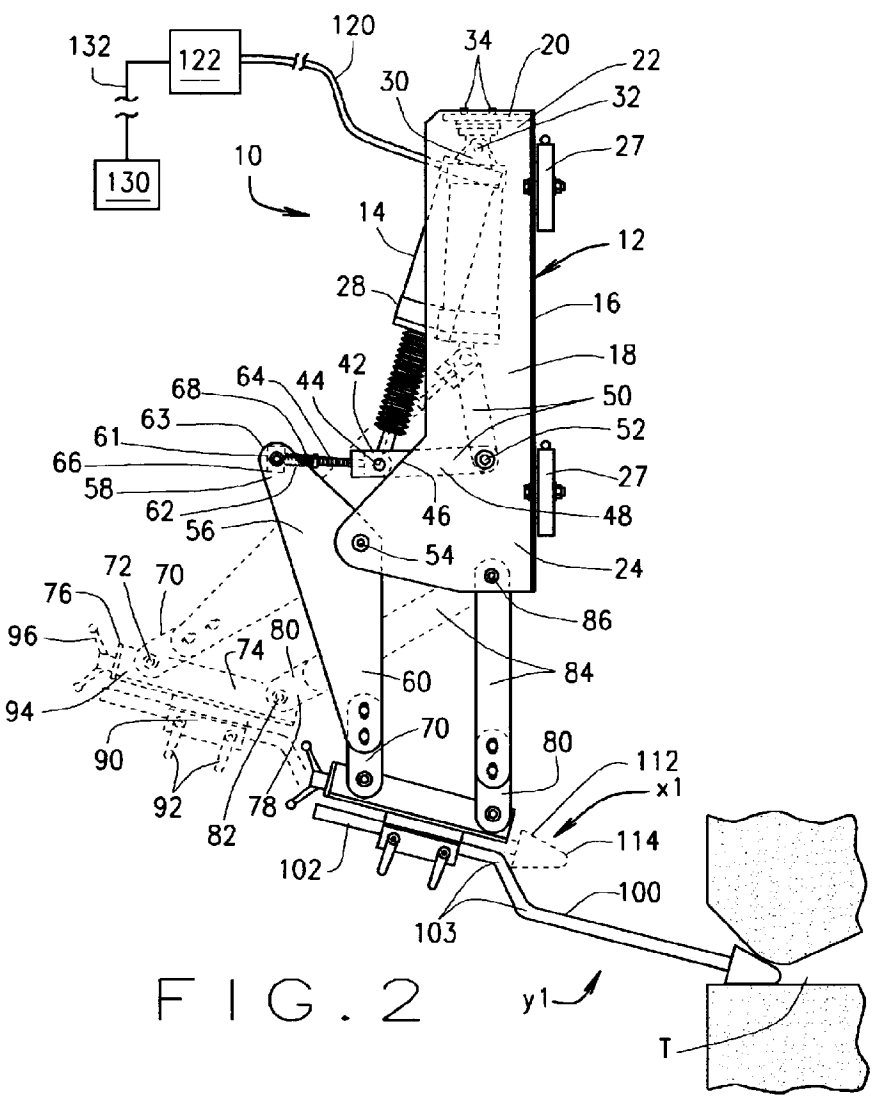
FIG. 2 is a side view of the molten metal tapping flow controller of FIG. 1 depicting two alternate positions of certain elements of the flow controller.

In referring to the drawings, an embodiment of the novel discrete molten metal flow controller 10 for a metal melt oven or furnace (collectively hereinafter "Melt Furnace") of the present invention is shown generally in FIGS. 1-2, where one embodiment of the present invention is depicted by way of example. As can be seen, the tapping flow controller 10 has a rectangular metal housing 12 that surrounds and provides a base for an actuator or cylinder 14, which could be for example air, electrical or hydraulic. The housing 12 comprises a flat rectangular back plate 16, two parallel side plates 18 and a top plate 20. The side plates 18 each have an upper end 22 and a lower end 24, and are rigidly attached in a perpendicular orientation to the back plate 16. The top plate 20 is likewise rigidly attached in a perpendicular orientation to the back plate 16, and spans in a perpendicular manner between the upper ends 22 of the side plates 18, thereby joining the upper ends 22. Preferably, the housing 12 is formed of heavy gage steel, or other such strong rigid material, that is welded along each of the junctions between the plates 16, 18 and 20 to provide substantial structural rigidity and integrity to the housing 12. Four mounting holes 25 are positioned near the four corners of the back plate 16. Mounting fixtures 27 configured to secure the tapping flow controller 10 to a Melt Furnace are shown attached to the holes 25 in FIG. 2.

The cylinder 14 has a pivot end 26 with a single direction pivot assembly 30 that pivots about a horizontal pivot pin 32, and an actuation end 28 opposite the pivot end 26. A set of four bolts and associated washers and nuts 34 removably and rigidly attach the pivot assembly 30 to the inner surface of the top plate 20. The pivot end 26 is attached to the top plate 20 in an orientation to allow the cylinder 14 to freely pivot about the pivot pin 32 away from and toward the back plate 16 in a vertical arc.

A retractable piston rod 40 extends axially through and away from the actuation end 28 of the cylinder 14, and has a pivot joint 42 opposite the actuation end 28. A horizontal pivot pin 44 pivotally joins the pivot joint 42 with opposing first ends 46 of a pair of vertically oriented opposing parallel plates 48 having second ends 50 opposite the first ends 46. The plates 48 are pivotally attached at their second ends 50 to a horizontal pivot pin 52 rotationally attached to the central portion of the side plates 18 as shown. A pair of vertically oriented triangular-shaped opposing parallel plates 56 are pivotally joined together by a horizontal pivot pin 54 that spans between generally central apex portions of the parallel plates. The pivot pin 54 also pivotally joins the parallel plates 56 to the side plates 18 at a position on the side plates below the pivot pin 52 and further away from the back plate 16. The plates 56 each have an upper portion 58 and a lower portion 60.

Figure 1:
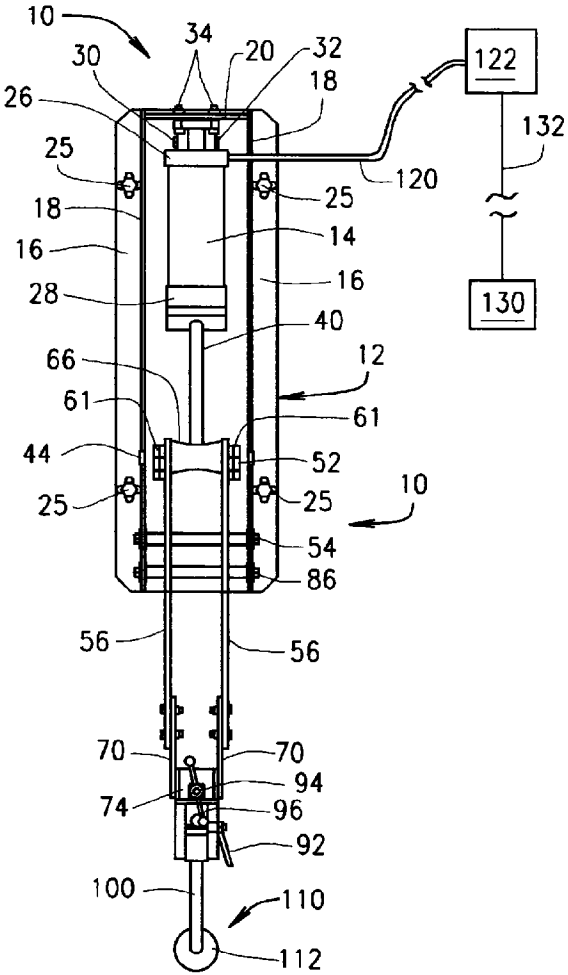
FIG. 1 is a front view of a molten metal tapping flow controller incorporating one embodiment of the present invention.
Figure 9:
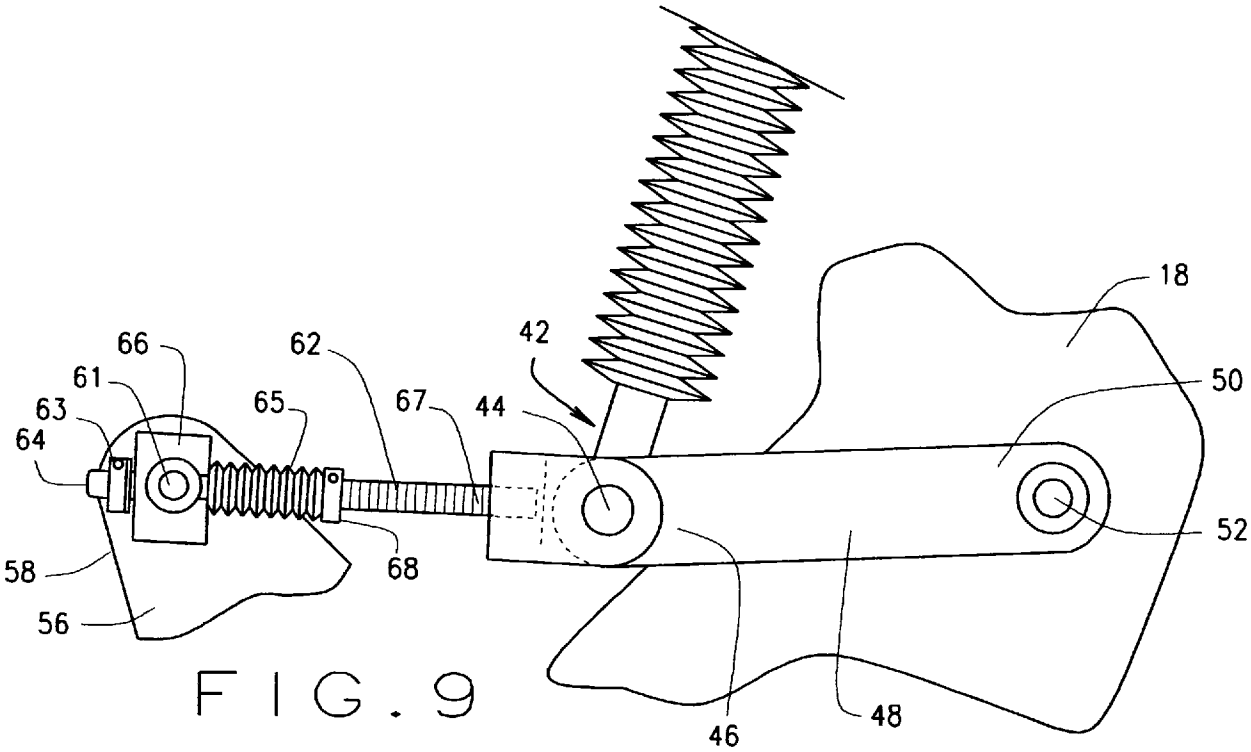
FIG. 9 is a side view of certain components of the molten metal tapping flow controller of FIG. 1.
Figure 10:
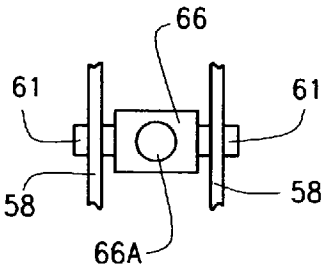
FIG. 10 is a front view of certain components including the pivot block of the molten metal tapping flow controller of FIG. 1.

Referring to FIGS. 1, 2 and particularly in FIG. 9, a pivot block 66, having coaxial pivot lugs 61 rigidly affixed to and extending from opposite sides of the block 66, is positioned between the upper portions 58 of the plates 56 (FIG. 10). The lugs 61 rotatably extend through bores in the upper portions 58 such that the lugs 61 and block 66 can pivot about the axis of the lugs 61 between the upper portions 58. A through bore 66A is positioned in the pivot block 66 substantially midway between the lugs 61 and perpendicular to the axis of the lugs 61. The through bore 66A is sized and shaped to slidably receive a first end 64 of a threaded adjustment rod 62 having a second end 67 opposite the first end 64. (FIG. 9). The first end 64 of the rod 62 extends beyond the through bore 66A where a first adjustment nut 63 secures the first end in place. A second adjustment nut 68 is positioned along the rod 62 on the opposite side of the block 66, and a series of cone-disc spring washers (also known as "Belleville" washers) 65 are positioned there between. Of course, other biasing devices, such as for example one or more heavy compression springs, may alternatively be used in place of the washers 65. Moreover, while beneficial, it is not necessary to configure the flow controller 10 to include the washers 65. Yet, when included, Belleville washers, such as the washers 65 can be stacked to increase their cumulative spring load. Further, Belleville washers can be stacked face to face or face to back to achieve a variety of varying load capacities. The number and stacking arrangement of the washers 65 and the positioning of the nut 68 are coordinated so as to partially compress the washers 65 to impart a bias between the nut 68 and the block 66. The second end 67 of the rod 62 is pivotally attached to the pivot joint 42 with pin 44. This arrangement allows for the ready adjustment of the plates 56 relative to the pivot pin 44.

The lower ends 60 of the opposing plates 56 rigidly attach to two opposing parallel extension plates 70. A pivot pin 72 pivotally joins the lower ends of the extension plates 70 to an outer end 76 of a pair of parallel elongated rectangular braces 74, each having an inner end 78 opposite the outer end 76. A pivot pin 82 rotatably joins the inner end 78 of each of the braces 74 pivotally to a pair of opposing parallel extension plates 80. The extension plates 80 are rigidly attached to the lower ends of a pair of opposing parallel plates 84. A pivot pin 86 pivotally joins the upper ends of the plates 84 pivotally to the lower ends of the side plates 18 near the back plate 16.

A dual clamp 90, having two tightening mechanisms 92, is rigidly attached to the underside of the brace 74. An adjustment device 94 with a manual wing adjustment handle 96 is incorporated in the brace 74 and can be used to manually adjust the position of the clamp 90 along the underside of the brace 74 between the inner end 78 and the outer end 76 of the brace 74. Of course other devices other than a wing adjustment handle as at 96, such as for example a wheel or a ratchet, may be implemented to achieve the same end.

A shaped rod 100, having a distal end 102 and a parallel proximal end 104, is removably secured along its distal end 102 to the brace 74 by the clamp 90. The rod 100 has two complimentary angular bends 103 of approximately 45 degrees each between the distal and proximal ends 102 and 104 near the center of the rod. It is contemplated that the shape of the rod 100 is dependent upon the specific application and can be altered from the embodiment disclosed herein so as to enable the flow controller 10 to properly integrate with a wide variety of Melt Furnace configurations. A short infundibular plunger or plug 110, having a tail 112 and a tip 114, is coaxially and rigidly attached at its tail 112 to the proximal end 104 of the rod 100. The plug 110 is sized and shaped to mate with a tap hole T in a Melt Furnace (FIG. 2).

A control line 120, preferably configured to operate at elevated temperatures, operatively connects the cylinder 14 to a remote automated or computerized control system 122. (FIGS. 1, 2). A fluid flow sensor 130 (shown schematically in FIG. 1), configured to sense height of molten metal in a trough and thereby measure the flow rate of molten metals from the increases and decreases in the height of the molten metal in the trough, is operatively connected to the control system 122 by a cable 132. Alternately, metal flow data from the sensor 130 can be transmitted wirelessly to the system 122 or through any other reasonable method. When properly positioned in the path of molten metal from a Melt Furnace, the sensor 130 detects and measures the metal flow from the tap hole and provides flow rate readings to the system 122 through the cable 132. Of course, it is also possible to utilize a sensor that directly monitors the metal flow rate. The control system 122 can increase or decrease the movement of the cylinder 14 through the line 120, which thereby remotely controls the actuation of the cylinder's piston rod 40. A computer algorithm entered into the system 122 dictates the timing and amount of the increases and decreases in cylinder 14 movement depending on the molten metal flow rate detected by the sensor 130. It is further contemplated that stroke sensors (not shown) can be added to the molten metal flow controller 10 to detect the exact position of the plug 110 as a feedback for the algorithm entered into the system 122, and also provides end of strokes safety limits. Such sensors may include, for example, a "home" position sensor, also operatively connected to the system 122 that can assist in placing the device at a repeatable fixed orientation at the start of each operation or operation cycle. As can be appreciated by one of ordinary skill in the art, when the tapping flow controller 10 is properly mounted, aligned and adjusted on a Melt Furnace with a tap hole, and the sensor 130 detects that the molten metal flow rate has exceeded a predetermined level for a predetermined period of time, the system 122 can be programmed to increase the movement of the cylinder 14 sufficient to push out the piston rod 40 away from the cylinder 14. In turn, the piston rod 40 pushes the first ends 46 of the plates 48 away from the cylinder 14. Because the second ends 50 are rotatably attached to the side plates 18 with the pivot pin 52, the first ends 46 move away from the cylinder 14 in an arc about the pivot pin 52. As the first ends 46 rotate, they push the adjustment rod 62 against the upper portions 58 of the plates 56 away from the housing 12 about the pivot pin 54, and thereby rotate the lower portions 60 toward the area of the Melt Furnace below the tapping flow controller 10.

Because the extension plates 70 rotatably attach the lower portions 60 of plates 56 to the outer end 76 of the brace 74, the extension plates 80 rotatably attach the lower ends of the plates 84 to the inner end 78 of the brace 74, and the upper ends of the plates 84 rotatably attached to the side plates 18 of the housing 12, the rotation of the plates 56 push the brace 74 toward the area of the Melt Furnace below the tapping flow controller 10 where the Melt Furnace tap hole T is located. Because the brace 74 holds the rod 100 having at its proximal end 104 the plug 110, the plug 110 is likewise rotated about the same arc toward the Melt Furnace. One such change in position for the plug 110 is depicted by way of example in FIG. 2, where the plug 110 is shown in a position x1, where the plug 110 is withdrawn away from the tap hole T, and in rotation to a position y1, where the plug 110 is fully engaged with the tap hole T. FIG. 2 also depicts the dual positions for all the linkages interconnecting the plug 110 and cylinder 14 in relation to the plug's positions at x1 and y1.

Of course, the system 122 can instruct the cylinder 14 to reverse this process by retracting the piston rod 40, and through the very same linkages, pull the plug 110 away from the area of the Melt Furnace below the tapping flow controller 10. Moreover, because it is finitely controlled as opposed for example to a binary "ON-OFF" control, the cylinder 14 can move the plug 110 to any discrete position from the position assumed by the plug 110 when the piston rod 40 is fully retracted into the cylinder 14, to the position assumed by the plug 110 when the piston rod 40 is fully extended from the cylinder 14. It will be recognized that other actuation mechanisms may alternatively be used in place of the control cylinder 14, such as for example, hydraulic cylinders, a jack-screw drive, or electric linear actuators. In any case, the control cylinder 14, or other such actuation device with similar capabilities, provides significantly superior control to the location of the plug 110 for the tapping flow controller 10. Of course, the range of the control may be limited by many configuration and application parameters, such as for example the position of the Melt Furnace tap hole relative to the housing 12; the specific shapes, sizes and configurations of the linkage plates 48, 56, 70 and 84; the adjusted settings of the adjustment rod 62; the lengths, dimensions and shape of the rod 100; the position of the rod 100 in the brace 74; etc.

As can be readily understood, the tapping flow controller 10 has multiple adjustment mechanisms to vary the operation of the device. For example, the distance between the upper portions 58 of the plates 56 and the first ends 46 of the plates 48 can readily be increased or decreased by rotating the adjustment nut 68 along the adjustment rod 64. As another example, the position of the rod 100 can be adjusted forward or rearward in the clamp 90, thereby changing the position of the plug 110 relative to the rest of the tapping flow controller 10. These, and other various adjustment mechanism incorporated in the tapping flow controller 10, provide substantial flexibility in operation and adaptability in mating the tapping flow controller 10 to different Melt Furnaces having varying configurations.

Figure 3:
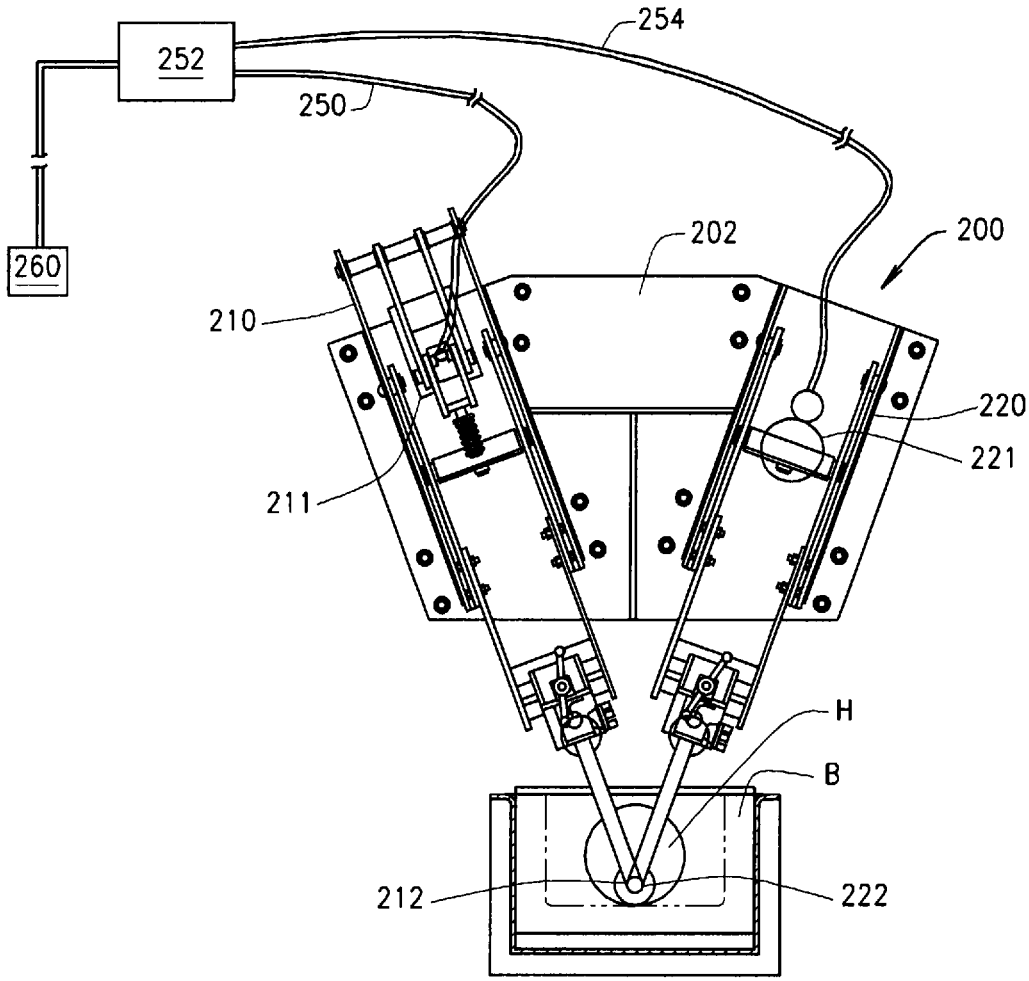
FIG. 3 is a front view of a combination tapper and molten metal flow controller apparatus incorporating an alternate embodiment of the present invention.

Turning now to FIG. 3, an automated combination Melt Furnace tapper and molten metal flow controller apparatus 200 is disclosed as an alternate embodiment of the present invention. The apparatus 200 is show in relation to a Melt Furnace tap hole H formed in a tap hole block B, with the apparatus positioned above the tap hole H. The apparatus 200 has a binary tap hole tapper component 210 and a discrete metal flow control component 220 that work in conjunction with one another. The flow control component 220 has a control cylinder 221 and a tap hole plunger or plug 222 operatively connected to the control cylinder 221 and positioned to enable the plug 222 to move into and away from the tap hole H. The flow control component 220 is similar to the tapping flow controller 10 configuration depicted in FIGS. 1 and 2, but is instead adapted to mount on the front face of a mounting plate 202. While an entire controller such as the embodiment 10 can be mounted to the plate 202, in the embodiment of FIG. 3, the back plate 16 is not present as in the tapping flow controller 10, and the side plates 18 are instead welded directly to the plate 202. Like the cylinder 14 of the flow control component 220, the control cylinder 221 of the flow control component 220 actuates the plug 222 to control the position of the plug 222 in relation to a designated tap hole for the Melt Furnace to which the apparatus 200 is attached.

The flow control component 220 is mounted to the plate 202 adjacent to the automated Melt Furnace tap hole tapper component 210 having a control cylinder 211 and a tap hole plunger or plug 212 operatively connected to the cylinder 211 and positioned to enable the plug 212 to move to alternately close and/or open the tap hole H. The tapper 210 may be a conventional commercially available product such as the Gillespie+Powers Autotapper Model Number 995, but having a modified configuration to mount directly to the plate 202 as shown. As is understood in the art, an automated tapper on its own, such as for example the Autotapper Model Number 995, is capable of remotely closing or opening a Melt Furnace tap hole with a plug such as the plug 212, but does not provide refined control of the flow of molten metal from such Melt Furnace tap hole.

A control line 254 operatively connects the cylinder 221 of the flow control component 220 to a computerized controller 252. Likewise, a control line 250 operatively connects the cylinder 211 of the tapper component 210 to the computerized controller 252. A fluid flow sensor 260 (shown schematically in FIG. 3), configured to sense the flow rate of molten metals, is operatively connected to the computerized controller 252 by a cable 262. Alternately, metal flow data from the sensor 260 can be transmitted wirelessly to the controller 252 or through any other reasonable method. When properly positioned in the path of molten metal from a Melt Furnace, the sensor 260 detects and measures the metal flow from the Melt Furnace's tap hole H and provides flow rate readings to the controller 252 through the cable 262. The controller 252 can increase or decrease the actuation of the cylinder 221, which thereby remotely controls the actuation of the plug 222 to move the plug 222 further into or further away from the tap hole H to increase or decrease the size of the opening in the tap hole H and thereby control the flow of molten metal from the tap hole H.

A computer algorithm programmed into the controller 252 dictates the timing and amount of the increases and decreases in the actuation of the control cylinder 221 in response to the changes in the molten metal flow rate detected by the sensor 260. In addition, the algorithm in the controller 252 simultaneously regulates the operation of the tapper 210 by controlling the cylinder 211 to either open or shut the tap hole H using the plug 212. However, the operation of both components 210 and 220 must be coordinated. For example, when the algorithm in the controller 252 is programmed to completely shut off the tap hole H and end all metal flow from the Melt Furnace at a particular point in time or in response to some other occurrence, the controller 252 first must instruct the flow control component 220 to move the plug 222 away from the tap hole H a sufficient distance to provide the tapper component plug 212 unhindered and full access to the tap hole H. Without coordinated control, the plugs 212 and 222 could easily interfere with the operation of one another, potentially damage the metal flow control component 220 or the tap hole tapper component 212 or both, and could disrupt or otherwise improperly control the flow of molten metal from the tap hole H.

Figure 4:
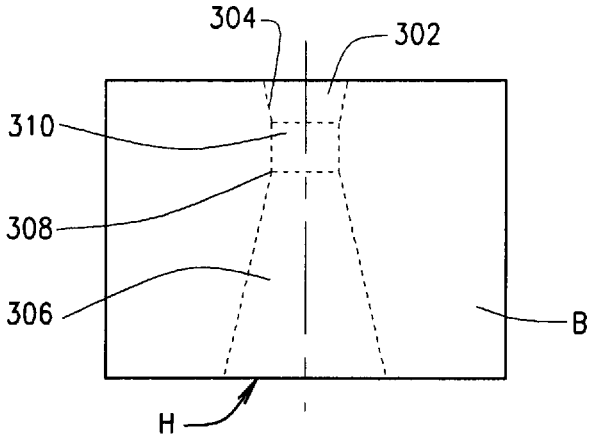
FIG. 4 is a top view of an embodiment of a ceramic tap hole block of the present invention, illustrating internal features of the block.
Figure 5:
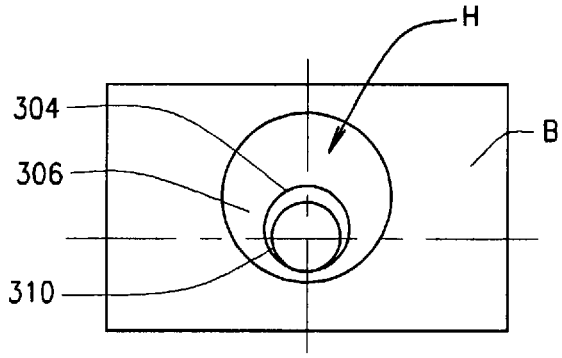
FIG. 5 is a front view of the tap hole block of FIG. 4, illustrating internal features of the block.
Figure 6:
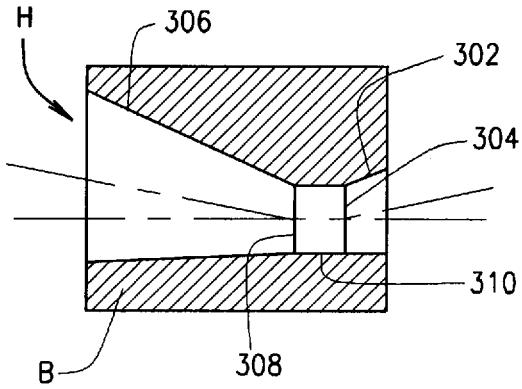
FIG. 6 is a side sectional view of the tap hole block of FIG. 4, illustrating internal features of the block.

FIGS. 4-6 depict further details of one configuration of the tap hole block B, formed of a high temperature ceramic material. In this configuration, the tap hole block B is rectangular and brick-like in shape and incorporates a tap hole H. Tap hole H is formed of an inner distended frustoconical bore 302 having a planar apex 304 and a larger opposing outer distended frustoconical bore 306, having a planar apex 308. When the block B is mounted to a Melt Furnace, the inner frustoconical bore 302 faces into and is exposed to the molten metal inside the Melt Furnace, while the outer frustoconical bore 306 faces away from the Melt Furnace. The apexes 304 and 308 have the same circular shape and are parallel to one another. The frustoconical bores 302 and 306 are joined at their apexes 304 and 308 by a cylindrical bore 310 having the same circular cross section as the apexes 304 and 308. While the frustoconical bores 302 and 306 are vertically coplanar with the cylindrical bore 310, the frustoconical bores 302 and 306 each diverge in an upward fashion from the axis of the cylindrical bore 310 by an angle of approximately 30 degrees. Further, the shape of the frustoconical bores 302 and 306 is not right, but is instead skewed in an upward direction. Hence, the lower ends of the bases of the frustoconical bores 302 and 306 each dip just slightly below the bottom of the cylindrical bore 310 while the upper ends of the bases of the frustoconical bores 302 and 306 extend substantially above the height of the top of the cylindrical bore 310.

The size and shape of the inner frustoconical bore 302 is designed to direct the molten metal from the Melt Furnace into and facilitate the flow of the molten metal through the tap hole H. However, the unique shape of the outer frustoconical bore 306 is designed to reliably and repeatably receive and release a tap hole plug such as for example one or more of the plugs 110, 212 or 222, as the plug is moved in an arc toward and away from the tap hole H by one of said molten metal tapping flow controllers 10, or either of the flow controller 220 or the tapper component 210 of an apparatus 200 of the present invention, or even a commercially available tapper such as for example the Gillespie+Powers Autotapper Model Number 995.

Although the upper frustoconical bore 306 can be substantially larger or smaller in diameter at its base and have a greater or smaller volume than the plugs it is adapted to receive, such as the plugs 110, 212 or 222, the bore 306 is nonetheless configured to snugly receive one or more of such plugs within its body. Further, the upper end of the outer frustoconical bore 306 is skewed upward, in the depicted configuration by approximately 30 degrees. These dimensions enable the outer frustoconical bore 306 to form oversized ports for the plugs, such as the plugs 110, 212 or 222, to enter, and to thereby accommodate the arcuate movement of the plugs toward and away from the tap hole H and also to accommodate to some extent misalignment of the plugs with the tap hole H.

Figure 8:
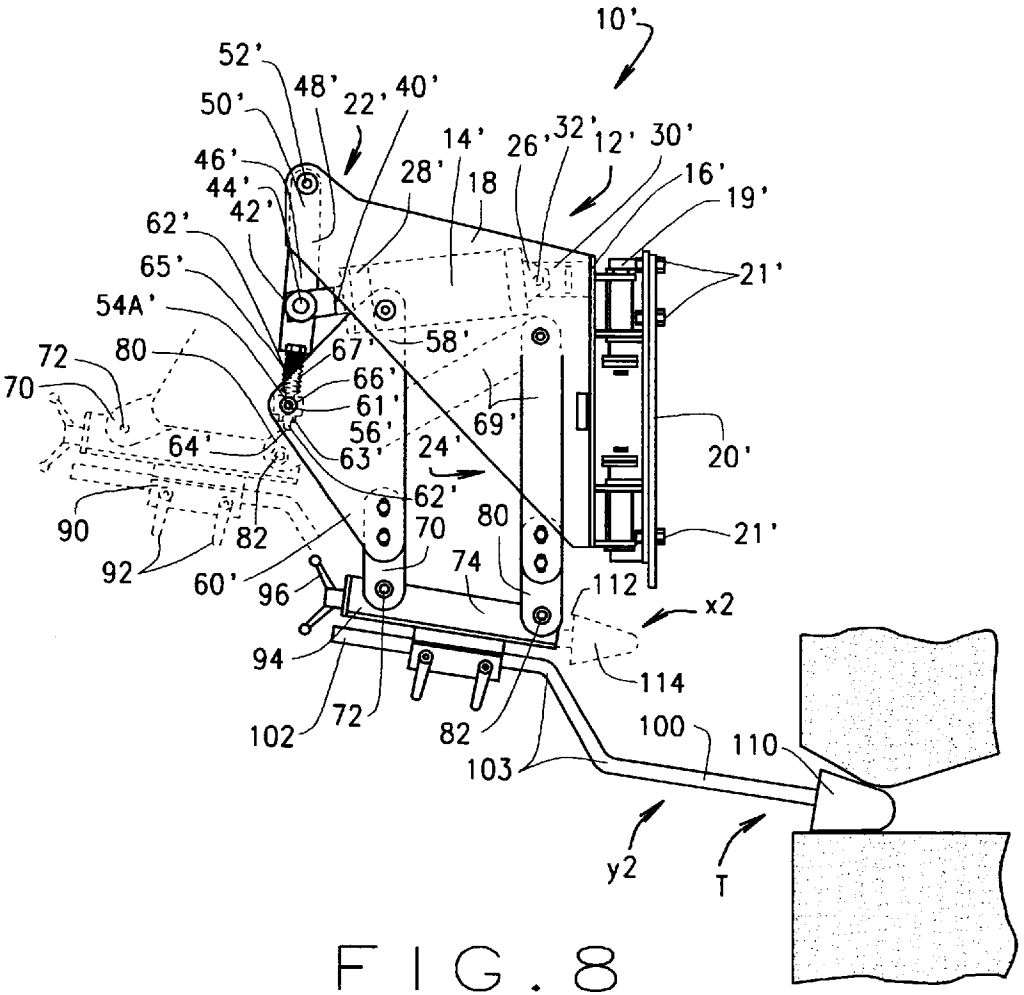
FIG. 8 is a side view of the molten metal tapping flow controller of FIG. 7 depicting two alternate positions of certain elements of the flow controller.
Figure 7:
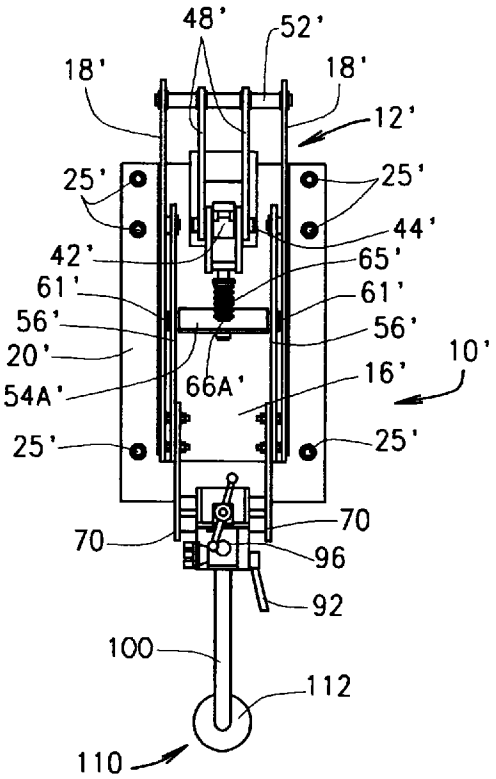
FIG. 7 is a front view of a molten metal tapping flow controller in a compact frame assembly incorporating an alternate embodiment of the present invention.

FIGS. 7 and 8 depict yet another alternate embodiment of the novel molten metal flow tapping controller of the present disclosure. In this embodiment, the controller 10' has a more compact frame than the embodiment of the controller 10. As can be seen, the lower structure of the controller 10' is the same as that of the controller 10. That is, both have the same parallel extension plates 70, pivot pin 72, opposing parallel rectangular braces 74, each having an inner end 78 opposite an outer end 76, opposing parallel extension plates 80, pivot pin 82, opposing parallel plates 84, pivot pin 86, dual clamp 90, two tightening mechanisms 92, adjustment device 94 with a manual wing adjustment handle 96, shaped rod 100, having a distal end 102 and a parallel proximal end 104, the rod 100 having two complimentary angular bends 103 of approximately 45 degrees each between the distal and proximal ends 102 and 104 near the center of the rod, short infundibular plug 110 having a tail 112 and a tip 114; all arranged and interrelated with one another in the same manner in both embodiments 10 and 10'.

However, the upper structure of embodiment 10' utilizes a different, more compact, configuration of components than the embodiment 10 to facilitate the controlled movement of the plug 110 into and out of the tap hole T. Additionally, the embodiment 10' includes a hinge configuration to provide and additional range of adjustments for the tapping controller 10. As can be seen, the tapping flow controller 10' has a rectangular metal housing 12' that surrounds and provides a rotatable base for an actuator or cylinder 14', which could be for example air, electrical or hydraulic. The housing 12' comprises a flat rectangular back plate 16' and two parallel side plates 18'. The side plates 18' each have an upper end 22' and a lower end 24', and are rigidly attached in a perpendicular orientation to the back plate 16'. A vertically oriented hinge 19' rotatably attaches the back plate 16' to a mounting plate 20'. Bolts 21', or other appropriate attachment devices, secure the plate 20' to a wall of a Melt Furnace or to other suitable vertical surface. In this way, when mounted to a vertical surface, the flow controller 10' can pivot about the vertical axis of the hinge 19'. Preferably, the housing 12', the hinge 19' and the plate 20' are all formed of heavy gage steel, or other such strong rigid material, that is welded along each of the junctions between the plates 16' and 18' to provide substantial structural rigidity and integrity to the housing 12'. Six mounting holes 25' are positioned along the outer edges of the back plate 20'. The bolts 21' are configured to fit through the holes 25' and secure the tapping flow controller 10' to a Melt Furnace.

The cylinder 14' has a pivot end 26' with a single direction pivot assembly 30' that pivots about a horizontal pivot pin 32', and an actuation end 28' opposite the pivot end 26'. The pivot assembly 30' is rigidly attached to the inner surface of the back plate 16'. The pivot end 26' is attached to the back plate 16' in an orientation to allow the cylinder 14' to freely pivot about the pivot pin 32' away from and toward the back plate 16' in a vertical arc.

A retractable piston rod 40' extends axially through and away from the actuation end 28' of the cylinder 14', and has a pivot joint 42' opposite the actuation end 28'. A horizontal pivot pin 44' pivotally joins the pivot joint 42' with opposing lower ends 46' of a pair of vertically oriented opposing parallel plates 48' having upper ends 50' opposite the lower ends 46'. The plates 48' are pivotally attached at their upper ends 50' to a horizontal pivot pin 52' rotationally attached to an upper tip of the side plates 18' as shown. A pair of vertically oriented triangular-shaped opposing parallel plates 56' are pivotally joined together by a horizontal pivot block 54' that spans between generally central apex portions of the parallel plates. The pivot block 54' has coaxial pivot lugs 61' rigidly affixed to and extending from opposite sides of the block 66', such that the pivot lugs 61' extend through bores in the apices of the parallel plates 56' such that the lugs 61' and block 54' can pivot about the axis of the lugs 61' between the apices of the parallel plates 56'.

A through bore 66A' is positioned in the pivot block 54A' substantially midway between the lugs 61' and perpendicular to the axis of the lugs 61'. The through bore 66A' is sized and shaped to slidably receive a first end 64' of a threaded adjustment rod 62' having a second end 67' opposite the first end 64'. The first end 64' of the rod 62' extends beyond the through bore 66A where a first adjustment nut 63' secures the first end in place. The second end 67' extends to and screws into a threaded bore at the base of a pivot block 54B'. The pivot block 54B' in turn is rotatably attached at its upper end to the pivot pin 42' such that the block 54B' can freely rotate about the pin 42'. A series of cone-disc spring washers (also known as "Belleville" washers) 65' are positioned along the rod 62' between the block 54A' and the block 54B'. Of course, other biasing devices, such as for example one or more heavy compression springs, may alternatively be used in place of the washers 65'. Moreover, while beneficial, it is not necessary to configure the flow controller 10 to include the washers 65. Yet, when included, the number and stacking arrangement of the washers 65' and the positioning of the nut 68' along the rod 62' are coordinated so as to partially compress the washers 65' to impart a bias between the nut 68' and the blocks 54A' and 54B'. This arrangement allows for the ready adjustment of the plates 56' relative to the pivot pin 44'.

The plates 56' each have an upper portion 58' and a lower portion 60' with a corner at the end of each portion. The upper portions 58' of the plates 56' pivotally attach to the central portion of the side plates 14' such that the plates 56' can pivot in a vertical arc. The lower portions 60' of the plates 56' are rigidly attached to the upper ends of the plates 70'. Vertically oriented parallel plates 69', positioned behind the plates 56' and nearer to the back plate 16', rigidly attach at their lower ends to the upper ends of the plates 80', and rotatably attach at their upper ends to the side plates 14', near the back plate 16' as show, such that the plates 69' can pivot in a vertical arc.

As would be readily understood by one of ordinary skill in the art, when all of the components of the controller 10' are properly assembled as depicted in FIGS. 7 and 8, through the extension of the piston rod 40' out of the cylinder 14', the controller 10' moves the plug 110 away from the tap hole T. Conversely, by retracting the piston rod 40' into the cylinder 14', the controller 10' moves the plug 110 toward and into the tap hole T.

It will be recognized that other actuation mechanisms may alternatively be used in place of the control cylinder 14', such as for example, hydraulic cylinders a jack screw drive, or electric linear actuators. In any case, the control cylinder 14', or other such actuation device with similar capabilities, provides significantly superior control to the location of the plug 110 for the tapping flow controller 10'. Of course, the range of the control may be limited by many configuration and application parameters, such as for example the position of the Melt Furnace tap hole relative to the housing 12'; the specific shapes, sizes and configurations of the linkage plates; the adjusted settings of the adjustment rod 62'; the lengths, dimensions and shape of the rod 100; the position of the rod 100 in the brace 74; etc. Of course, the exact location and orientation of each pivot point and each connection between the components of the tapper controller 10' will be dictated by the requirement that the controller 10' function to controllably move the plug 110 into and away from the tap hole T.

While we have described in the detailed description two configurations that may be encompassed within the disclosed embodiments of this invention, numerous other alternative configurations, that would now be apparent to one of ordinary skill in the art, may be designed and constructed within the bounds of our invention as set forth in the claims. Moreover, each of the above-described novel features of the present invention can be arranged in a number of other and related varieties of configurations without expanding beyond the scope of our invention as set forth in the claims.

Additional variations or modifications to the configuration of the novel Melt Furnace tap hole tapping flow control and tapper system of the present invention may occur to those skilled in the art upon reviewing the subject matter of this invention. Such variations, if within the spirit of this disclosure, are intended to be encompassed within the scope of this invention. The description of the embodiments as set forth herein, and as shown in the drawings, is provided for illustrative purposes only and, unless otherwise expressly set forth, is not intended to limit the scope of the claims, which set forth the metes and bounds of our invention.

What is claimed is:

1. A molten metal flow controller for controlling the release of molten metal from a tap hole in a metal melt furnace, the molten metal having a flow rate through the tap hole, the flow controller comprising:

a first plunger controllably movable into and out of the tap hole, the first plunger shaped and sized to close at least in part the tap hole when the first plunger is positioned in the flow of molten metal from the tap hole between a first position and a second position in proximity to the tap hole, the first position being nearer to the tap hole than the second position, the first plunger reducing the flow rate of molten metal from the tap hole as the first plunger moves from the second position toward the first position, the first plunger allowing an increase in the flow rate of molten metal from the tap hole as the first plunger moves from the first position toward the second position;

a first actuator operatively associated with the first plunger, the first actuator controllably moving the first plunger in a discrete manner between the first and second positions; and a second plunger removably insertable into the tap hole to fully close the tap hole;

a second actuator operatively associated with the second plunger, the second actuator being operable to move the second plunger between a closed position at which the second plunger fully blocks the flow of the molten metal through the tap hole, and an open position at which the second plunger is withdrawn from the tap hole to allow the molten metal to flow through the tap hole;

a sensor operatively associated with the first actuator, the sensor measuring the flow rate of the molten metal from the tap hole, generating a signal representative of the measured flow rate, and communicating said signal to the first actuator;

wherein when the flow rate from the tap hole is less than a first predetermined value the first actuator moves the first plunger away from the first position and toward the second position in response to the sensor signal until the sensor signal communicates to the first actuator that the measured flow rate equals the first predetermined value, and wherein when the flow rate from the tap hole is greater than a second predetermined value the first actuator moves the first plunger away from the second position and toward the first position in response to the sensor signal until the sensor signal communicates to the first actuator that the measured flow rate equals the second predetermined value.

2. The molten metal flow controller of claim1, further comprising an attachment device removably attaching the flow controller to a side of the furnace in proximity to the tap hole.

3. The molten metal flow controller of claim 1, further comprising a programmable computer processor operatively associated with the first actuator and the sensor, the computer processor receiving the signal representative of the measured flow rate and being programmed with a set of computer operational instructions to instruct the first actuator to move the first plunger between the first position and the second position in response to said signal.

4. The molten metal flow controller of claim 3, wherein the computer processor is operatively associated with the second actuator, the computer processor being programmed with a set of computer operational instructions to instruct the second actuator to move the second plunger between the open position and the closed position.

5. The molten metal flow controller of claim 1, wherein the first actuator controllably moves the first plunger in an incremental manner between the first and second positions.

6. The molten metal flow controller of claim 1, wherein the first actuator controllably moves the first plunger in a discrete manner between the first and second positions.

7. The molten metal flow controller of claim 1, wherein the first predetermined rate equals the second predetermined rate.

8. A molten metal flow controller for controlling the flow rate of molten metal through a tap hole in a metal melt furnace, the controller comprising:

a first plunger configured to be removably insertable into the tap hole;

a first actuator operatively associated with the first plunger, the first actuator moving the first plunger relative to the tap hole to control the flow of the molten metal through the tap hole;

a second plunger removably insertable into the tap hole to fully close the tap hole;

a second actuator operatively associated with the second plunger, the second actuator being operable to move the second plunger between a closed position at which the second plunger fully blocks the flow of the molten metal through the tap hole, and an open position at which the second plunger is withdrawn from the tap hole to allow the molten metal to flow through the tap hole; and a programmable computer processor operatively associated with the first actuator, the processor being programmed with a set of computer operational instructions to instruct the first actuator to move the first plunger to one of a plurality of positions in proximity to the tap hole and at least in part in the flow of molten metal from the tap hole, each of the said plurality of positions corresponding to predetermined flow rate of molten metal through the tap hole.

9. The molten metal flow controller of claim 8, wherein the programmable controller instructs the first actuator to move the first plunger away from the tap hole when the flow rate of the molten metal is less than a predetermined value.

10. The molten metal flow controller of claim 8, wherein the programmable controller instructs the first actuator to move the first plunger toward the tap hole when the flow rate is greater than a predetermined value.

11. The molten metal flow controller of claim 8, further comprising a sensor operatively associated with the computer processor; the sensor measuring the flow rate of molten metal through the tap hole, generating a signal representative of the measured flow rate, and communicating the flow rate signal to the computer processor; the computer processor instructing the first actuator to move the first plunger in response to the sensor signal.

12. The molten metal flow controller of claim 8, wherein the sensor measures the height of molten metal in a trough into which molten metal flows from the tap hole.

13. The molten metal flow controller of claim 8, wherein the first actuator controllably moves the first plunger in an incremental manner between the first and second positions.

14. The molten metal flow controller of claim 13, wherein the first actuator controllably moves the first plunger in a discrete manner between the first and second positions.

15. An apparatus for tapping a metal melt furnace and controlling the flow of molten metal through a tap hole in the furnace comprising:

a binary tapper having a first actuator and a first plunger, the first plunger configured to be removably insertable into the tap hole and to fully close the tap hole when fully inserted therein, the first actuator operatively connected to the first plunger and configured to alternately fully insert the first plunger into the tap hole to preclude the flow of molten metal through the tap hole or retract the first plunger from the tap hole to allow for the flow of molten metal through the tap hole; and a discrete tapper having a second actuator and a second plunger, the second plunger removably insertable into the tap hole, the second actuator operatively connected to the second plunger and configured to position the second plunger relative to the tap hole at one or more discrete locations in the flow of molten metal exiting the tap hole.

16. The apparatus of claim 15 wherein the second actuator is further configured to position the second plunger fully out of the flow of molten metal from the tap hole.

17. The apparatus of claim 15, further comprising a sensor configured to measure the flow rate of molten metal through the tap hole and generate an output of the flow rate data.

18. The molten metal flow controller of claim 17, wherein the sensor is configured to indirectly measure the molten metal flow by measuring the height of molten metal in a trough into which molten metal flows from the tap hole.

19. The apparatus of claim 17 wherein the second actuator is further configured to receive the flow rate data from the sensor and directs the second plunger away from the tap hole when the flow of molten metal is less than a predetermined flow rate and directs the second plunger toward the tap hole when the flow rate is greater than a predetermined flow rate.

20. The apparatus of claim 17, further comprising a programmable controller programmed with an algorithm that controls the second actuator to operate the positioning of the second plunger.

21. The apparatus of claim 19, wherein the programmable controller is configured to receive the flow rate data from the sensor and use the flow rate data to control the second actuator.

22. A method of controlling the flow of molten metal from a metal melt furnace having a tap hole, the molten metal having a flow rate through the tap hole, the method comprising the steps of:

monitoring the flow rate of the molten metal through the tap hole;

moving a first plunger from a closed position at which the first plunger closes the tap hole to an open position at which the first plunger allows the molten metal to flow through the tap hole;

moving a second plunger from a first position at which the second plunger does not restrict the flow of molten metal through the tap hole along a first path of motion to a second position in proximity to the tap hole at which the second plunger restricts the flow of molten metal through the tap hole, the first plunger being out of the second plunger first path of motion;

moving the second plunger toward the tap hole to reduce flow of molten metal through the tap hole when the flow rate is greater than a first predetermined value; and moving the second plunger away from the tap hole to increase the flow of molten metal through the tap hole when the flow rate is less than a second predetermined value.

23. The method of claim 22, further comprising the step of moving the second plunger to the first position along a second path of motion, the first plunger being out of the second plunger second path of motion.

24. The method of claim 22, further comprising the step of moving the first plunger to the closed position after moving the second plunger to the first position.

25. The method of claim 22, wherein the first predetermined value equals the second predetermined value.

* * * * *